US005288070A

United States Patent [19]

Chen

[11] Patent Number: 5,288,070

[45] Date of Patent: Feb. 22, 1994

[54] GOLF CLUB HEAD OF COMPOSITE MATERIAL

[76] Inventor: Archer C. C. Chen, 35, Yichaong E. Road, Taipin, Taichung County, Taiwan

[21] Appl. No.: 28,262

[22] Filed: Mar. 9, 1993

[51] Int. Cl.[5] ..... A63B 53/04

[52] U.S. Cl. ..... 273/78; 273/167 H; 273/173; 273/DIG. 23

[58] Field of Search ..... 273/167 H, 167 R, 167 J, 273/169, 173, 167 F, 78, DIG. 23, 162 R, 164.1, 167 D, 167 K, 170, 171, 174, 175, 77 R, 77 A, 193 R, 194 R

[56] References Cited

U.S. PATENT DOCUMENTS

| | | | |
|---|---|---|---|
| 838,284 | 12/1906 | Thompson et al. | 273/78 |
| 1,562,956 | 11/1925 | Guerne | 273/78 |
| 1,907,134 | 5/1933 | Weiskopf | 273/78 |
| 1,968,626 | 7/1934 | Young | 273/78 |
| 2,429,351 | 10/1947 | Fetterolf | 273/78 |
| 4,884,812 | 12/1989 | Nagasaki et al. | 273/173 X |
| 4,964,640 | 10/1990 | Nakanishi et al. | 273/167 H |
| 5,106,094 | 4/1992 | Desbiolles et al. | 273/173 X |

FOREIGN PATENT DOCUMENTS

| | | | |
|---|---|---|---|
| 211781 | 12/1957 | Australia | 273/167 F |
| 4-261680 | 9/1992 | Japan | 273/167 R |

*Primary Examiner*—Vincent Millin
*Assistant Examiner*—Sebastiano Passaniti
*Attorney, Agent, or Firm*—Browdy and Neimark

[57] ABSTRACT

A golf club head of composite material comprises an outer shell, an inner shell, a base plate, and a front wall. The outer shell of a metal material is provided with a receiving space and a neck having therein a shaft hole in communication with the receiving space. The inner shell of a fiber-reinforced resin material is adhered to the inner wall of the receiving space of the outer shell and is provided with a cell facing the open end of the outer shell and with an annular shoulder adjacent to the open end of the outer shell. The base plate is arranged on the annular shoulder of the inner shell so as to seal off the cell of the inner shell and to form a shaping slot located between the base plate and the open end of the outer shell. The front wall of a fiber-reinforced resin material is embedded in the shaping slot to form a ball-striking face of the golf club head.

5 Claims, 2 Drawing Sheets

GOLF CLUB HEAD OF COMPOSITE MATERIAL

FIELD OF THE INVENTION

The present invention relates to a golf club head, and more particularly to a golf club head having an inner shell and an outer shell which are made of a composite material.

BACKGROUND OF THE INVENTION

A golf club head made of a fiber-reinforced resin material is superior to a golf club head of a metal material in terms of the ball-striking capability. However, the golf club head of the fiber-reinforced resin material has its own share of shortcoming because such fiber-reinforced resin material is inherently less wear-resistant and is therefore vulnerable to damage upon being impacted. In addition, such golf club head of the fiber-reinforced resin material generates a relatively greater shock upon hitting a ball, thereby placing the golf club head under greater stress and strain.

SUMMARY OF THE INVENTION

It is therefore the primary objective of the present invention to provide a golf club head with an outer shell of metal toward which a greater part of the overall weight of the golf club head is directed. Therefore, the golf club head of the present invention has a greater sweet spot and is less likely to be subjected to stress and strain upon hitting a ball.

It is another objective of the present invention to provide a golf club head of a composite material with an inner shell and an outer shell for reinforcing the structure of the golf club head and for mitigating shock upon hitting a ball.

In keeping with the principles of the present invention, the foregoing objectives of the present invention is attained by a golf club head of composite material, which comprises an outer shell, an inner shell, a base plate, and a front wall. The outer shell of metal is made integrally by casting and is shaped according to the main body of the golf club head. The outer shell is provided with a recessed receiving space corresponding in location to the ball-striking face of the golf club head. A neck is located at an upper corner of the outer shell such that the neck extends upwardly and obliquely. The neck is provided therein a shaft hole which is in communication with the receiving space and is used for mounting therein a golf club. The inner shell of fiber-reinforced resin material is adhered securely to the inner wall of the receiving space of the outer shell. The inner shell is provided with a cell facing the open end of the outer shell and with an annular shoulder adjacent to the open end of the outer shell. The base plate is disposed on the surface of the annular shoulder so as to seal off the cell of the inner shell. Located between the base plate and the open end of the outer shell is a shaping slot, which is filled with the front wall of fiber-reinforced resin material to form a ball-striking face of the golf club head.

DETAILED DESCRIPTION OF THE PREFERRED EMBODIMENT

Figure 1:
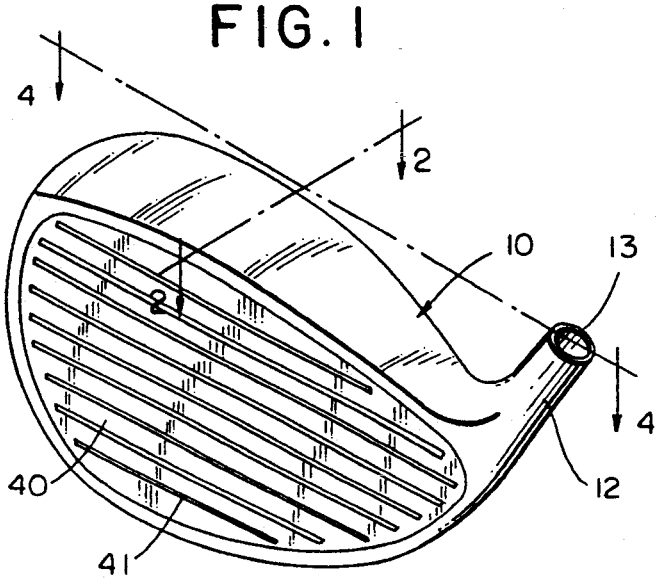
FIG. 1 shows a perspective view of the present invention.
Figure 2:
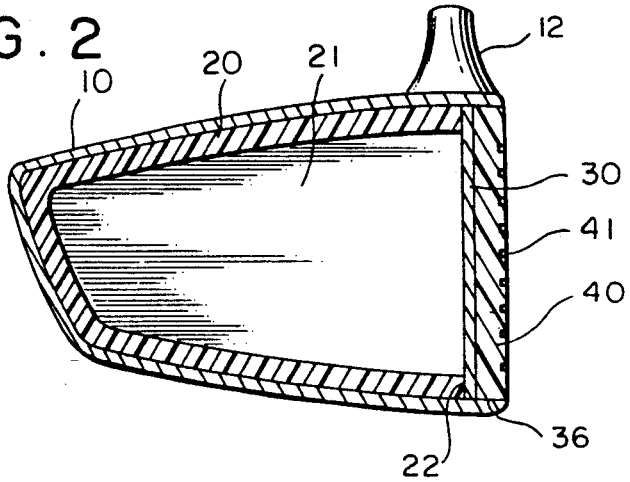
FIG. 2 shows a sectional view of a portion taken along the line 2—2 as shown in FIG. 1.
Figure 3:
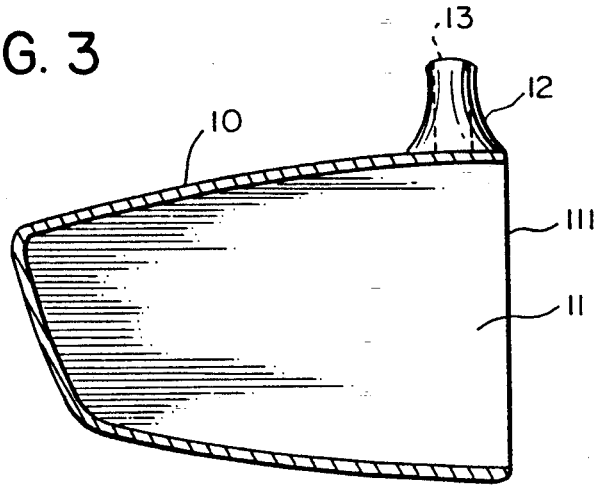
FIG. 3 shows a schematic view of a metal outer shell as shown in FIG. 2.
Figure 4:
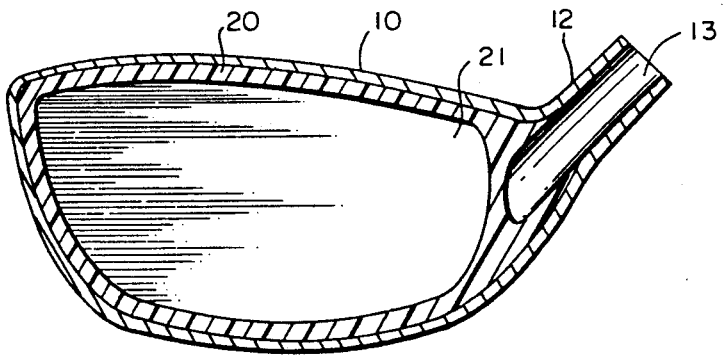
FIG. 4 shows a sectional view of a portion taken along the line 4—4 as shown in FIG. 1.

Referring to FIGS. 1–4, a golf club head of the present invention is made of a composite material and is composed of an outer shell 10, an inner shell 20, a base plate 30, and a front wall 40.

The outer shell 10 is made integrally of a metal material by casting and is shaped like a main body of the golf club head. The outer shell 10 is provided with a recessed receiving space 11 corresponding in location to the ball-striking face of the golf club head. Located at an upper right-hand corner of the outer shell 10 is a neck 12, which extends upwardly and obliquely and has a shaft hole 13 in communication with the receiving space 11 for receiving therein the golf club.

The inner shell 20 is made of a fiber-reinforced epoxy resin material and is adhered to the inner wall of the receiving space 11 of the outer shell 10. The inner shell 20 is provided with a cell 21 facing an open end 111 of the outer shell 10. Located near the open end 111 of the outer shell 10 is an annular shoulder 22.

The base plate 30 is made of aluminium, or copper, or titanium, or stainless steel, or the alloy of the above-mentioned metals, or fiber-reinforced resin composite material. The base plate 30 is placed on the shoulder 22 so as to seal off the cell 21 and to form a shaping slot 36 between the open end 111 of the outer shell 10 and the base plate 30.

The front wall 40 is made of fiber-reinforced epoxy resin and is embedded in the shaping slot 36 so as to seal off the open ends of the inner shell 20 and the outer shell 10. The front wall 40 is provided thereon with a plurality of linear grooves 41 to form a ball-striking face.

Figure 5:
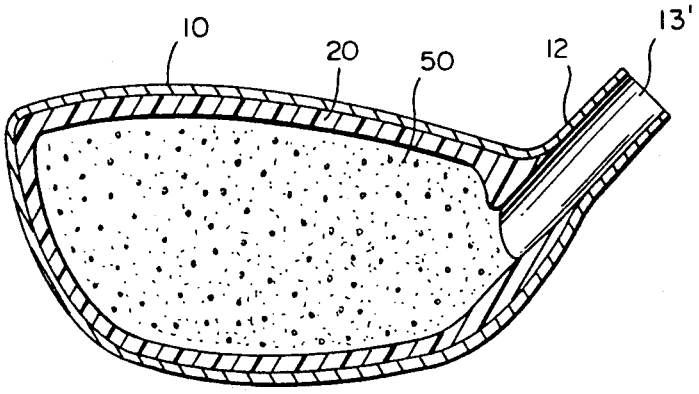
FIG. 5 is similar to FIG. 4 and is a schematic view showing an inner shell provided with a foam inner core.
Figure 6:
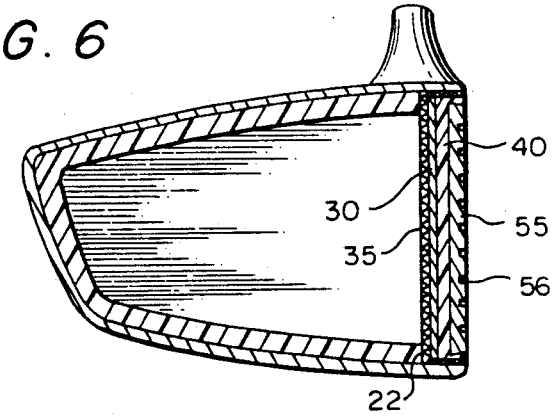
FIG. 6 is similar to FIG. 2 and is a schematic view showing that a ball-striking plate is embedded in a front wall of the present invention.

As shown in FIG. 5, a shaft hole 13' penetrates the inner shell 20 to be in communication with the cell 21. A lightweight foam material is introduced into the cell 21 via the shaft hole 13' so that an inner core 50 is formed in the cell 21. The inner core 50 makes the golf club head solid so as to prevent the golf club head from making a noise upon hitting a ball.

As shown in FIG. 61 a ball-striking plate 55 is embedded in the front wall 40 such that the surface of the plate 55 is in alignment with the surface of the front wall 40. The plate 55 is provided thereon with a plurality of linear grooves 56 to form a ball-striking face. The plate 55 may be made of a ceramic material or a titanium material, which hardens the ball-striking face.

An epoxy resin fiber fabric 35 is adhered to the back of base plate 30, the shoulder 22 and the shaping slot 36 to prevent the fiber-reinforced resin of the front wall 40 from getting into the cell 21 during the process of making the head. In addition, such epoxy resin fiber fabric 35 serves to enhance the adhering effect of the front wall 40 and the base plate 30 on the outer shell 10 and the inner shell 20.

Figure 7:
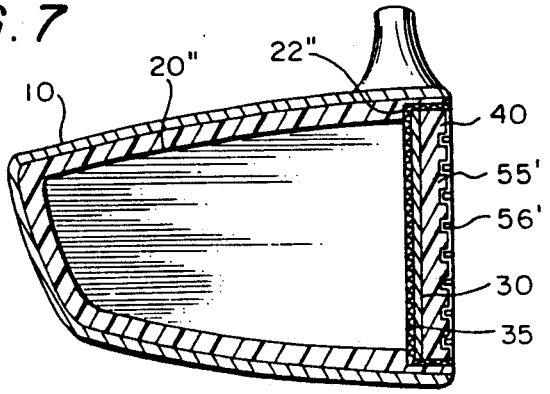
FIG. 7 is similar to FIG. 6 and is a schematic view showing that a different kind of ball-striking plate is embedded in the front wall of the present invention.

As shown in FIG. 7, a ball-striking plate 55', which is made integrally of a thin metal plate by punching and pressing to be of a corrugated construction, is embedded in the front wall 40 to form a wear-resistant covering for protecting the front wall 40 as well as the corner angles of the linear grooves 56'. The ball-striking plate 55' of a lightweight material reduces the overall weight of the golf club head and lowers the center of gravity of the golf club head.

Furthermore, as shown in FIG. 7, an inner shell 20'' extends to reach the open end 111 of the outer shell 10 so as to form a shoulder 22''. This is just an example that the inner shell 20 of the present invention may be embodied in other specific forms without deviating from the spirit of the present invention.

In the present invention as described above, the inner shell of a fiber-reinforced resin material is protected by the outer shell of a metal material. In addition, the inner shell and the outer shell of the golf club head of the present invention work to support each other in a complementary manner so as to enhance the structural integrity of the golf club head. As a result, the golf club head of the present invention generates a relatively small shock upon hitting a ball. Furthermore, the outer shell of the present invention may be made of a very thin metal material so as to increase the size of the golf club head in conformity with a standard weight of the golf club head. The center of gravity of the golf club head of the present invention can be lowered or moved backwards, thanks to the metal outer shell whose weight can be easily increased. The manufacturing process of the golf club head of the present invention is simplified in that the metal outer shell is made integrally by lost wax molding. The size of the sweet spot of the golf club head of the present invention is greatly increased in view of the fact that a greater part of the overall weight of the golf club head is directed toward the outer shell. The golf club head of the present invention is therefore less likely to be placed under stress and strain upon hitting a ball.

What is claimed is:

1. A golf club head of composite material comprising:

an outer shell shaped to have an open end and made integrally of a metal by casting and provided with a receiving space having an inner wall within said outer shell and with a neck which extends upwardly and obliquely therefrom and having a shaft hole in communication with said receiving space;

an inner shell of a fiber-reinforced resin material adhered to said inner wall of said receiving space of said outer shell and provided with a cell facing said open end of said outer shell and with an annular shoulder adjacent to said open end of said outer shell;

a base plate arranged on said shoulder so as to seal off said cell of said inner shell and to form a shaping slot located between said base plate and said open end of said outer shell; and a front wall of a fiber-reinforced resin material embedded in said shaping slot to form a ball-striking face.

2. The golf club head of composite material in accordance with claim 1 wherein an intermediate layer of a fiber fabric pre-impregnated in an epoxy resin is located between said base plate and said shoulder.

3. The golf club head of composite material in accordance with claim 1 wherein a core of lightweight foam material fills said inner shell.

4. The golf club head of composite material in accordance with claim 1 wherein said ball-striking face of said front wall has thereon a plurality of ball-striking linear grooves made integrally therewith.

5. The golf club head of composite material in accordance with claim 1 wherein a ball-striking plate is embedded in said front wall with an inner surface of said ball-striking plate in alignment with said ball-striking face of said front wall, said ball-striking plate having thereon a plurality of ball-striking linear grooves made integrally on an outer surface of ball-striking plate.

* * * * *